US009640191B2

(12) United States Patent
Fuchs et al.

(10) Patent No.: US 9,640,191 B2
(45) Date of Patent: May 2, 2017

(54) APPARATUS AND METHOD FOR PROCESSING AN ENCODED SIGNAL AND ENCODER AND METHOD FOR GENERATING AN ENCODED SIGNAL

(71) Applicant: Fraunhofer-Gesellschaft zur Foerderung der angewandten Forschung e.V., Munich (DE)

(72) Inventors: Guillaume Fuchs, Bubenrath (DE); Bernhard Grill, Lauf (DE); Manfred Lutzky, Nuremburg (DE); Markus Multrus, Nuremburg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 14/811,705

(22) Filed: Jul. 28, 2015

(65) Prior Publication Data

US 2015/0332700 A1 Nov. 19, 2015

Related U.S. Application Data

(63) Continuation of application No. PCT/EP2014/051593, filed on Jan. 28, 2014.

(Continued)

(51) Int. Cl.

| | |
|---|---|
| ***G10L 19/26*** | (2013.01) |
| *G10L 19/09* | (2013.01) |
| *G10L 19/02* | (2013.01) |

(52) U.S. Cl.

CPC ..... *G10L 19/26* (2013.01); *G10L 19/0204* (2013.01); *G10L 19/09* (2013.01)

(58) Field of Classification Search

None

See application file for complete search history.

(56) References Cited

U.S. PATENT DOCUMENTS 8,073,697 B2 * 12/2011 Cross, Jr. ..... G10L 13/00 704/270

8,706,480 B2 4/2014 Herre et al.

(Continued)

FOREIGN PATENT DOCUMENTS

EP 2099026 A1 9/2009

EP 2116998 A1 11/2009

(Continued)

OTHER PUBLICATIONS

Salami et al.; Design and Description of CS-ACELP: A Toll Quality 8 kb/s Speech Coder; IEEE Transactions on Speech and Audio Processing, vol. 6, No. 2, Mar. 1998; pp. 116-130.*

"Information technology—MPEG audio technologies—Part 3: Unified speech and audio coding", ISO/IEC FDIS 23003-3:2011(E); ISO/IEC JTC 1/SC 29/WG 11; STD Version 2.1c2, Sep. 20, 2011, 291 pages.

(Continued)

*Primary Examiner* — Abul Azad

(74) *Attorney, Agent, or Firm* — Michael A. Glenn; Perkins Coie LLP

(57) ABSTRACT

An apparatus for processing an encoded signal, the encoded signal having an encoded audio signal having information on a pitch delay or a pitch gain, and a bass post-filter control parameter, has: an audio signal decoder for decoding the encoded audio signal using the information on the pitch delay or the pitch gain to obtain a decoded audio signal; a controllable bass post-filter for filtering the decoded audio signal to obtain a processed signal, wherein the controllable bass post-filter has the variable bass post-filter characteristic controllable by the bass post-filter control parameter; and a controller for setting the variable bass post-filter characteristic in accordance with the bass post-filter control parameter included in the encoded signal.

18 Claims, 12 Drawing Sheets

Related U.S. Application Data

(60) Provisional application No. 61/758,075, filed on Jan. 29, 2013.

(56) References Cited

U.S. PATENT DOCUMENTS

| | | | | |
|---|---|---|---|---|
| 2004/0024597 | A1* | 2/2004 | Adut | G10L 19/113 704/233 |
| 2007/0282601 | A1* | 12/2007 | Li | G10L 19/005 704/207 |
| 2008/0052066 | A1* | 2/2008 | Oshikiri | G10L 21/038 704/221 |
| 2010/0010810 | A1 | 1/2010 | Morii et al. | |
| 2010/0262420 | A1 | 10/2010 | Herre et al. | |
| 2011/0307248 | A1* | 12/2011 | Yamanashi | G10L 21/038 704/205 |
| 2011/0320196 | A1* | 12/2011 | Choo | G10L 19/12 704/229 |
| 2012/0101824 | A1 | 4/2012 | Chen et al. | |
| 2013/0096912 | A1* | 4/2013 | Resch | G10L 19/20 704/207 |

FOREIGN PATENT DOCUMENTS

| | | | |
|---|---|---|---|
| RU | 2439721 | C2 | 1/2012 |
| RU | 2011117699 | A | 11/2012 |
| WO | WO-99/38155 | A1 | 7/1999 |
| WO | 2010040522 | A2 | 4/2010 |
| WO | WO-2012/000882 | A1 | 1/2012 |
| WO | WO-2012/110415 | A1 | 8/2012 |

OTHER PUBLICATIONS

"Universal Mobile Telecommunications System (UMTS); Mandatory Speech Codec speech processing functions AMR Wideband speech codec; Transcoding functions", ETSI TS 126 190 V5.1.0 (Dec. 2001); 3GPP TS 26.190 version 5.1.0 Release 5;, Dec. 2001, 55 pages.

Chen, et al., "Adaptive postfiltering for quality enhancement of coded speech", IEEE Transactions on Speech and Audio Processing, vol. 3, No. 1, Jan. 1995, pp. 59-71.

ETSI, TS126290, "Digital cellular telecommunications system (Phase 2+);", 3GPP TS 26.290 version 12.0.0 Release 12, Universal Mobile Telecommunications System (UMTS); LTE; Audio codec processing functions; Extended Adaptive Multi-Rate-Wideband (AMR-WB+) codec; Transcoding functions (3 GPP TS 26, Oct. 2014, 87 pages.

ITU-T, G.718, "Series G: Transmission Systems and Media, Digital Systems and Networks", Digital terminal equipments- Coding of voice and audio signals. Frame error robust narrow-band and wideband embedded variable bit-rate coding of speech and audio from 8-32 kbit/s., 2009, 257 pages.

Neuendorf, M. , "WD7 of USAC", International Organisation for Standardisation ISO/IEC JTC1/SC29/WG11, Coding of Moving Pictures and Audio, N11299; XP-002658193; Dresden, Germany, Apr. 2010, 84 pages.

Resch, B. et al., "CE proposal on improved Bass-post filter operation for the ACELP of USAC", International Organisation for Standardisation ISO/IEC JTC1/SC29/WG11; MPEG2010/M17831, Geneva, Switzerland, Jul. 2010, pp. 1-3.

* cited by examiner $$SNR_c = 10.\log\left(\frac{\sum_{n=0}^{N-1}(s(n))^2}{\sum_{n=0}^{N-1}(s(n) - \hat{s}(n))^2}\right) \quad (1)$$

$$SNR_{pf}(\alpha) = 10.\log\left(\frac{\sum_{n=0}^{N-1}(s(n))^2}{\sum_{n=0}^{N-1}(s(n) - \hat{s}(n) + \alpha(\hat{s}(n) * p_{LT}(n) * h_{LP}(n=)))^2}\right) \quad (2)$$

$$s_e(n) = (\hat{s}(n) * p_{LT}(n) * h_{LP}(n)) \quad (3)$$

$$\arg\max_{\alpha} SNR_{pf}(\alpha) = \arg\min_{\alpha} \sum_{n=0}^{N-1}(s(n) - \hat{s}(n) + \alpha, s_e(n))^2 \quad (4)$$

$$\tilde{\alpha} = -\frac{\sum_{n=0}^{N-1}(s(n) - \hat{s}(n)).s_e(n)}{\sum_{n=0}^{N-1}(s(n) - \hat{s}(n))^2} \quad (5)$$

$$index = \min\left(2^k - 1, \max\left(0, \frac{2^k - 1}{\alpha_{max} - \alpha_{min}}.\left(\frac{\tilde{\alpha}}{0.5g_{ltp}} - \alpha_{min}\right)\right)\right) \quad (6)$$

$$\alpha(index) = \left(\frac{\alpha_{max} - \alpha_{min}}{2^k - 1}.\ index + \alpha_{min}\right).0.5g_{ltp} \quad (7)$$

$$index_new = \underset{index-1, index, index+1}{\arg\max} SNR_{pf}(\alpha(index)) \quad (8)$$

FIG 7B

APPARATUS AND METHOD FOR PROCESSING AN ENCODED SIGNAL AND ENCODER AND METHOD FOR GENERATING AN ENCODED SIGNAL

CROSS-REFERENCE TO RELATED APPLICATIONS

This application is a continuation of copending International Application No. PCT/EP2014/051593, filed 28 Jan. 2014, which claims priority from U.S. Provisional Application No. 61/758,075, filed 29 Jan. 2013, which are each incorporated herein in its entirety by this reference thereto.

BACKGROUND OF THE INVENTION

The present invention is related to audio signal processing and particularly to audio signal processing in the context of speech coding using adaptive bass post-filters.

Bass post-filter is a post-processing of the decoded signal used in some speech coders. The post-processing is illustrated in FIG. 11 and is equivalent to subtracting from the decoded signal $\hat{s}(n)$ a long-term prediction error which is scaled and then low-pass filtered. The transfer function of the long-term prediction filter is given by:

$$P_{LT}(z) = 1 - \frac{1}{2}z^{-T} - \frac{1}{2}z^{+T}$$

where T is a delay which usually corresponds to the pitch of the speech or the main period of the pseudo-stationary decoded signal. The delay T is usually deduced from the decoded signal or from the information contained directly within the bitstream. It is usually the long-term prediction delay parameter already used for decoding the signal. It can also be computed on the decoded signal by performing a long-term prediction analysis. The post-filtered decoded signal is then equal to:

$$\widehat{s_{pf}}(n) = \hat{s}(n) - \alpha(\hat{s}(n) * p_{LT}(n) * h_{LP}(n))$$

where $\alpha$ is a multiplicative gain corresponding to the attenuation factor of the anti-harmonic components and $h_{LP}(n)$ is the impulse response of a low-pass filter. As for the delay T, the gain can come from directly the bitstream or computed form the decoded signal.

The bass post-filter was designed for enhancing the quality of clean speech but can create unexpected artifacts which can spoil the listening experience, especially when the anti-harmonic components are useful components in the original signal, as it can be the case for music or noisy speech. One solution of this problem can be found in [3], where the post-filter can be by-passed thanks to a decision determined either at the decoder side or at the encoder side. In the latest case, the decision needs to be transmitted within the bitstream as it is depicted in FIG. 12.

In particular, FIGS. 11 and 12 illustrate a decoder 1100 for decoding an audio signal encoded within a bitstream to obtain a decoded signal. The decoded signal is subjected to a delay in a delay stage 1102 and forwarded to a subtractor 1112. Furthermore, the decoded audio signal is input into a long-term prediction filter indicated by $P_{LT}(z)$. The output of the filter 1104 is input into a gain stage 1108 and the output of the gain stage 1108 is input into a low-pass filter 1106. The long-term prediction filter 1104 is controlled by a delay T and the gain stage 1108 is controlled by a gain $\alpha$. The delay T is the pitch delay and the gain $\alpha$ is the pitch gain.

Both values are decoded/retrieved by block 1110. Typically, the pitch gain and the pitch delay are additionally used by the decoder 1100 to generate a decoded signal such as a decoded speech signal.

FIG. 12 additionally has the decoder decision block 1200 and a switch 1202 in order to either use the bass post-filter or not. The bass post-filter is generally indicated by 1114 in FIG. 11 and FIG. 12.

It has been found that controlling the bass post-filter by the pitch information such as the pitch gain and the pitch delay or the complete deactivation of the bass post-filter are not optimum solutions. Instead, the bass post-filter can enhance the audio quality substantively if the bass post-filter is correctly set. On the other hand, the bass post-filter can seriously degrade the audio quality, when the bass post-filter is not controlled to have an optimum bass post-filter characteristic.

SUMMARY

According to an embodiment, an apparatus for processing an encoded signal, the encoded signal having an encoded audio signal having information on a pitch delay, a pitch gain, and a bass post-filter control parameter, may have: an audio signal decoder for decoding the encoded audio signal using the information on the pitch delay or the pitch gain to obtain a decoded audio signal; a controllable bass post-filter for filtering the decoded audio signal to obtain a processed signal, wherein the controllable bass post-filter has a variable bass post-filter characteristic controllable by the bass post-filter control parameter; and a controller for setting the variable bass post-filter characteristic in accordance with the bass post-filter control parameter included in the encoded signal, wherein the controllable bass post-filter has a filter apparatus having a long-term prediction filter, a gain stage, a signal manipulator, and a subtractor for subtracting an output of the filter apparatus from the decoded audio signal, wherein the bass post-filter control parameter has a quantized gain value for the gain stage), wherein the controller is configured to set the gain stage in accordance with the quantized gain value, wherein the controller has a block for decoding or retrieving the information on a pitch delay and wherein the controller is configured to set the long-term prediction filter in accordance with the pitch delay, wherein the controller is configured to retrieve the quantized gain value from the encoded signal to obtain the bass post-filter control parameter, to scale the pitch gain by a constant factor lower than 1 and greater than 0 to obtain a scaled pitch gain; and to calculate a setting of the gain stage using the scaled pitch gain and using the quantized gain value.

According to another embodiment, an encoder for generating an encoded signal may have: an audio signal encoder for generating an encoded audio signal having information on a pitch gain or a pitch delay from an original audio signal; a decoder for decoding the encoded audio signal to obtain a decoded audio signal; a processor for calculating a bass post-filter control parameter fulfilling an optimization criterion using the decoded audio signal and the original audio signal; and an output interface for outputting the encoded signal having the encoded audio signal having the information on the pitch gain or the pitch delay and the bass post-filter control parameter, wherein the processor further has a quantizer for quantizing the bass post-filter control parameter to one of a predetermined number of quantization indices, and wherein the processor is configured to calculate the bass post-filter control parameter so that the optimization criterion is fulfilled for a quantized bass post-filter control parameter.

According to another embodiment, a method of processing an encoded signal, the encoded signal having an encoded audio signal having information on a pitch delay, a pitch gain, and a bass post-filter control parameter, may have the steps of: decoding the encoded audio signal using the information on the pitch delay or the pitch gain to obtain a decoded audio signal; filtering the decoded audio signal to obtain a processed signal using a controllable bass post-filter having a variable bass post-filter characteristic controllable by the bass post-filter control parameter; and setting the variable bass post-filter characteristic in accordance with the bass post-filter control parameter included in the encoded signal, wherein the controllable bass post-filter has a filter apparatus having a long-term prediction filter, a gain stage, a signal manipulator, and a subtractor for subtracting an output of the filter apparatus from the decoded audio signal, wherein the bass post-filter control parameter has a quantized gain value for the gain stage or a filter characteristic information for the signal manipulator, and wherein the setting has setting the gain stage in accordance with the quantized gain value, or setting the signal manipulator in accordance with the information on the filter characteristic, wherein the setting has decoding or retrieving the information on a pitch delay and wherein the long-term prediction filter is set in accordance with the pitch delay, wherein the setting has retrieving the quantized gain value from the encoded signal to obtain the bass post-filter control parameter, scaling the pitch gain by a constant factor lower than 1 and greater than 0 to obtain a scaled pitch gain; and calculating a setting of the gain stage using the scaled pitch gain and using the quantized gain value.

According to still another embodiment, a method for generating an encoded signal may have the steps of: generating an encoded audio signal having information on a pitch gain or a pitch delay from an original audio signal; decoding the encoded audio signal to obtain a decoded audio signal; calculating a bass post-filter control parameter fulfilling an optimization criterion using the decoded audio signal and the original audio signal; and outputting the encoded signal having the encoded audio signal having the information on the pitch gain or the pitch delay and the bass post-filter control parameter, wherein the calculating further has quantizing the bass post-filter control parameter to one of a predetermined number of quantization indices, and wherein the bass post-filter control parameter is calculated so that the optimization criterion is fulfilled for a quantized bass post-filter control parameter.

Another embodiment may have a computer program for performing, when running on a computer or processor, the above methods.

An optimum control of the bass post-filter provides a significant audio quality improvement compared to a purely pitch information-driven control of the bass post-filter or compared to only activating/deactivating a bass post-filter. To this end, a bass post-filter control parameter is generated on the encoder-side typically using the encoded and again decoded signal and the original signal in the encoder, and this bass post-filter control parameter is transmitted to the decoder-side. In a decoder-side apparatus for processing an encoded signal, an audio signal decoder is configured for decoding the encoded audio signal using the pitch delay or the pitch gain to obtain a decoded audio signal. Furthermore, a controllable bass post-filter for filtering the decoded audio signal is provided to obtain a processed signal, where this controllable bass post-filter has a controllable bass post-filter characteristic controllable by the bass post-filter control parameter. Furthermore, a controller is provided for setting the variable bass post-filter characteristic in accordance with the bass post-filter control parameter included in the encoded signal in addition to the pitch delay or the pitch gain included in the encoded audio signal.

Thus, the bass post-filter is a filter applied at the output of some speech decoders and aims to attenuate the anti-harmonic noise introduced by a lossy coding of speech. In an embodiment, the optimal attenuation factor of the anti-harmonic components is calculated by means of a minimum mean square error (MMSE) estimator. Advantageously, the quadratic error between the original signal and the post-filtered decoded signal is the cost function to be minimized. The thus obtained optimal factor is computed at the encoder side before being quantized and transmitted to the decoder. In addition or alternatively, it is also possible to optimize at the encoder side the other parameters of the bass post-filtering, i.e. the pitch delay T and a filter characteristic. Advantageously, the filter characteristic is a low-pass filter characteristic, but the present invention is not restricted to only filters having a low-pass characteristic. Instead, other filter characteristics can be an all-pass filter characteristic, a band-pass filter characteristic or a high-pass filter characteristic. The index of the best filter is then transmitted to the decoder.

In further embodiments, a multi-dimensional optimization is performed by optimizing, at the same time, a combination of two or three parameters out of the gain/attenuation parameter, the delay parameter or the filter characteristic parameter.

BRIEF DESCRIPTION OF THE DRAWINGS

Embodiments are subsequently discussed in the context of the accompanying drawings and are additionally discussed in the enclosed dependent claims, in which:

FIG. 7*b* illustrates equations/steps performed by an apparatus/method for generating an encoded signal;

DETAILED DESCRIPTION OF THE INVENTION

Figure 1:
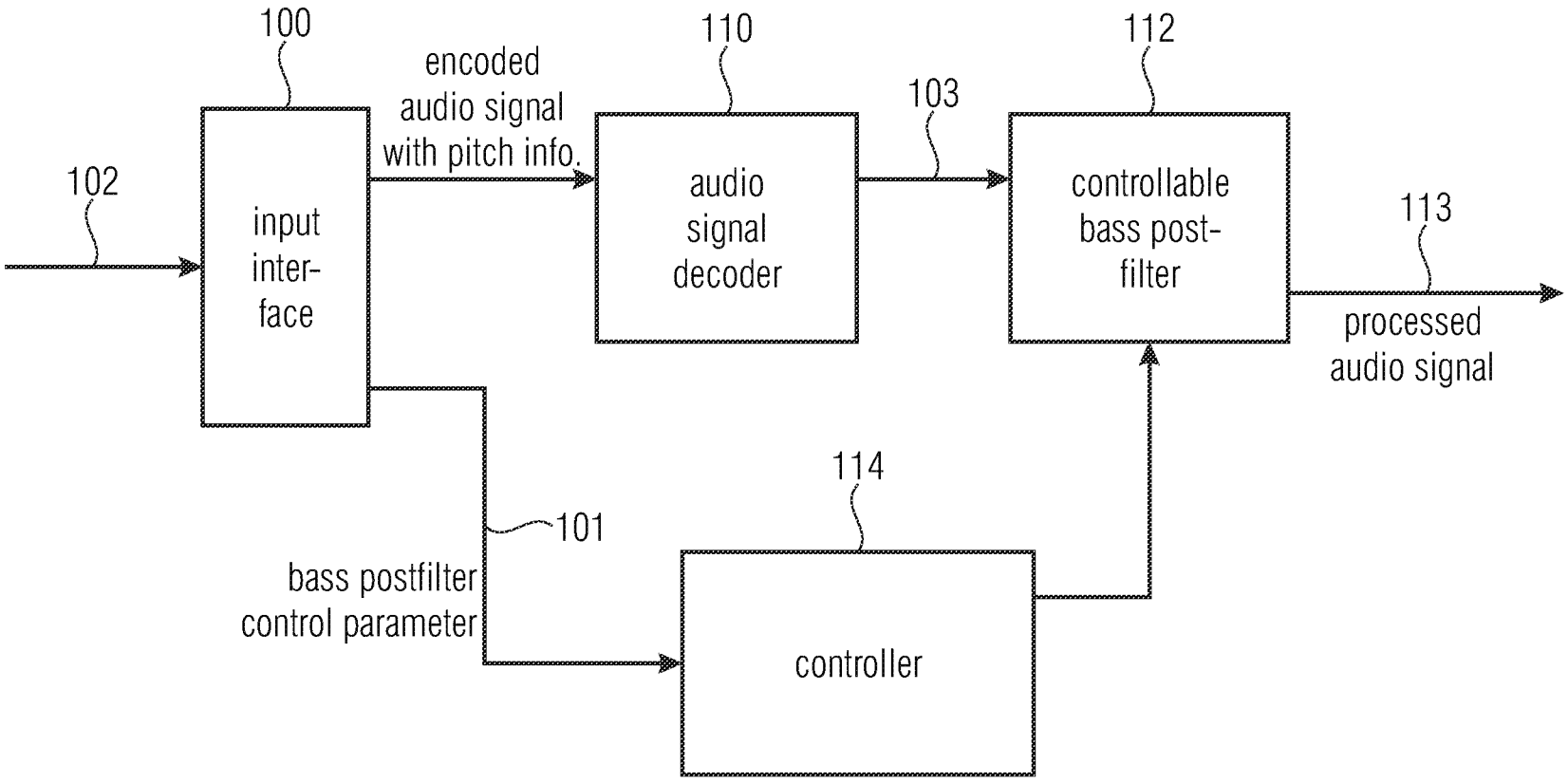
FIG. 1 illustrates an embodiment of an apparatus for processing encoded audio signal.

FIG. 1 illustrates the apparatus for processing encoded signal. The encoded signal is input into an input interface 100. At the output of the input interface 100, an audio signal decoder for decoding the encoded audio signal is provided. The encoded signal input into the input interface 100 comprises an encoded audio signal having an information on a pitch delay or a pitch gain. Furthermore, the encoded signal comprises a bass post-filter control parameter. This bass post-filter control parameter is forwarded from the input interface 100 to the controller 114 for setting a variable bass post-filter characteristic of a controllable bass post-filter 112 in accordance with the bass post-filter control parameter included in the encoded signal. This control parameter 101 is therefore provided in the encoded audio signal in addition to the information on the pitch delay or the pitch gain and may therefore be used to set the controllable bass post-filter characteristic in addition to the bass post-filter control parameters specifically included in the encoded signal 102.

Figure 2:
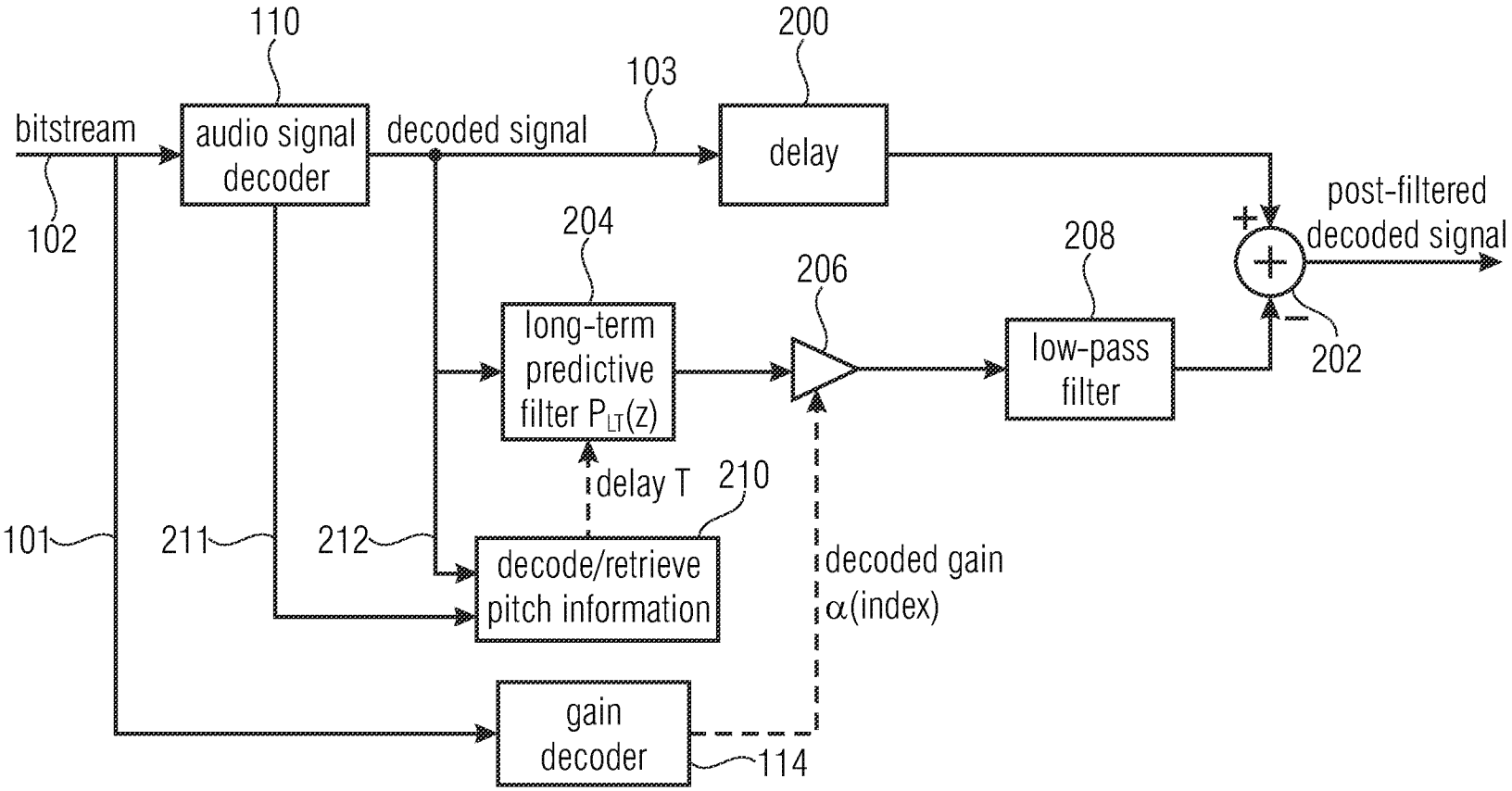
FIG. 2 illustrates a further embodiment of an apparatus for processing an encoded signal.

As illustrated in FIG. 2, the controllable bass post-filter 112 may comprise a long-term prediction filter $P_{LT}(z)$ indicated at 204, a subsequently connected gain stage 206 and a subsequently connected low-pass filter 208. In this context, however, it is emphasized that elements 204, 206, 208 can be arranged in any different order, i.e. the gain stage 206 can be arranged before the long-term prediction filter 204 or subsequent to the low-pass filter 208 and, equally, the order between the low-pass filter 208 the long-term prediction filter 204 can be exchanged so that the low-pass filter 208 is the first in the chain of processing. Furthermore, the characteristics of the prediction filter 204, the gain stage 206 and the low-pass filter 208 can be merged into a single filter (or into two cascaded filters) having a product of the transfer functions of the three elements.

Figure 11:
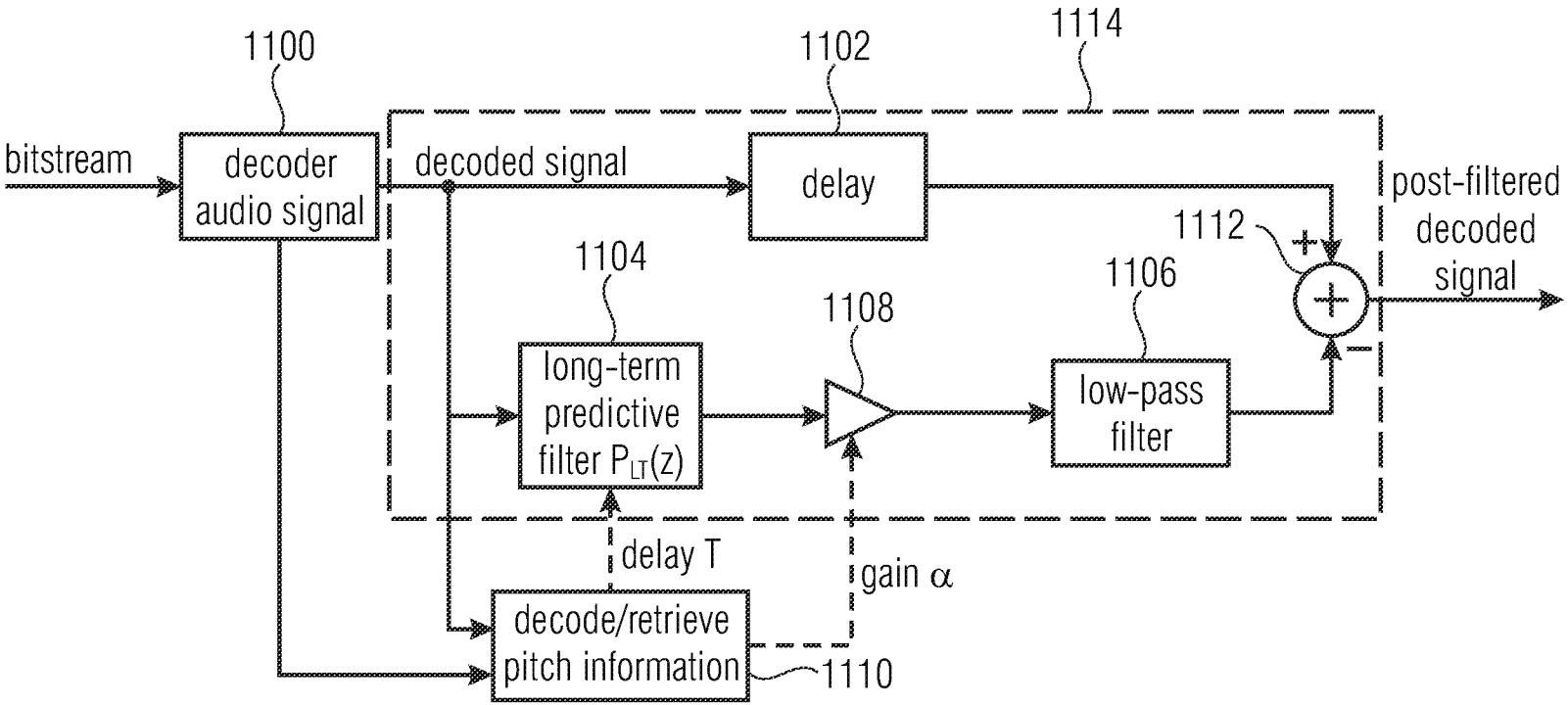
FIG 11 (PRIOR ART)
FIG. 11 illustrates a known signal processing apparatus.
Figure 12:
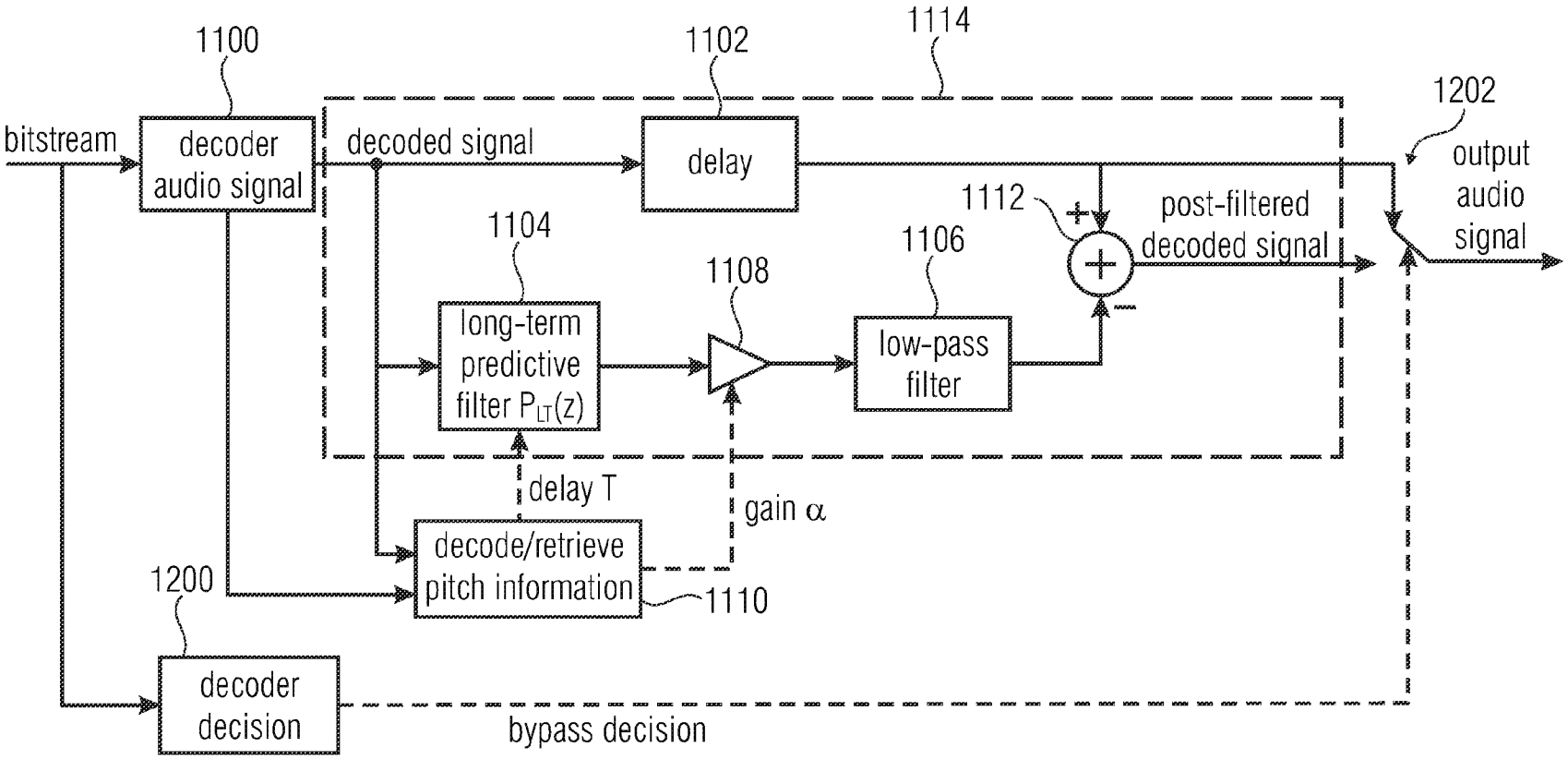
FIG 12 (PRIOR ART)
FIG. 12 illustrates a further known signal processing apparatus.

In FIG. 2, the bass post-filter control parameter 101 is a gain value for controlling the gain stage 206 and this gain value 101 is decoded by the gain decoder 114 which is included in the controller 114 of FIG. 1. Thus, the gain decoder 114 provides a decoded gain α(index) and this value is applied to the variable gain stage 206. The result of the procedures in FIG. 1 and FIG. 2 and the other procedures of the present invention is a processed or post-filtered decoded signal having a superior quality compared to the procedures illustrated in FIG. 11 and FIG. 12. In particular, the controller 114 in FIG. 1 additionally comprises a block 210 for decoding/retrieving pitch information, i.e. information on a pitch delay T and/or information on a pitch gain $g_{ltp}$. This derivation of this data can either be performed by simply reading the corresponding information from the encoded signal illustrated by line 211 or by actually analyzing the decoded audio signal illustrated by line 212. However, when the audio signal decoder is a speech decoder, then the encoded audio signal will comprise explicit information on a pitch gain or a pitch delay. However, when this information is not present, it can be derived from the decoded signal 103 by block 210. This analysis may, for example, be a pitch analysis or pitch tracking analysis or any other well-known way of deriving a pitch of an audio signal. Additionally, the block 210 cannot only derive the pitch delay or pitch frequency but can also derive the pitch gain.

Figure 3:
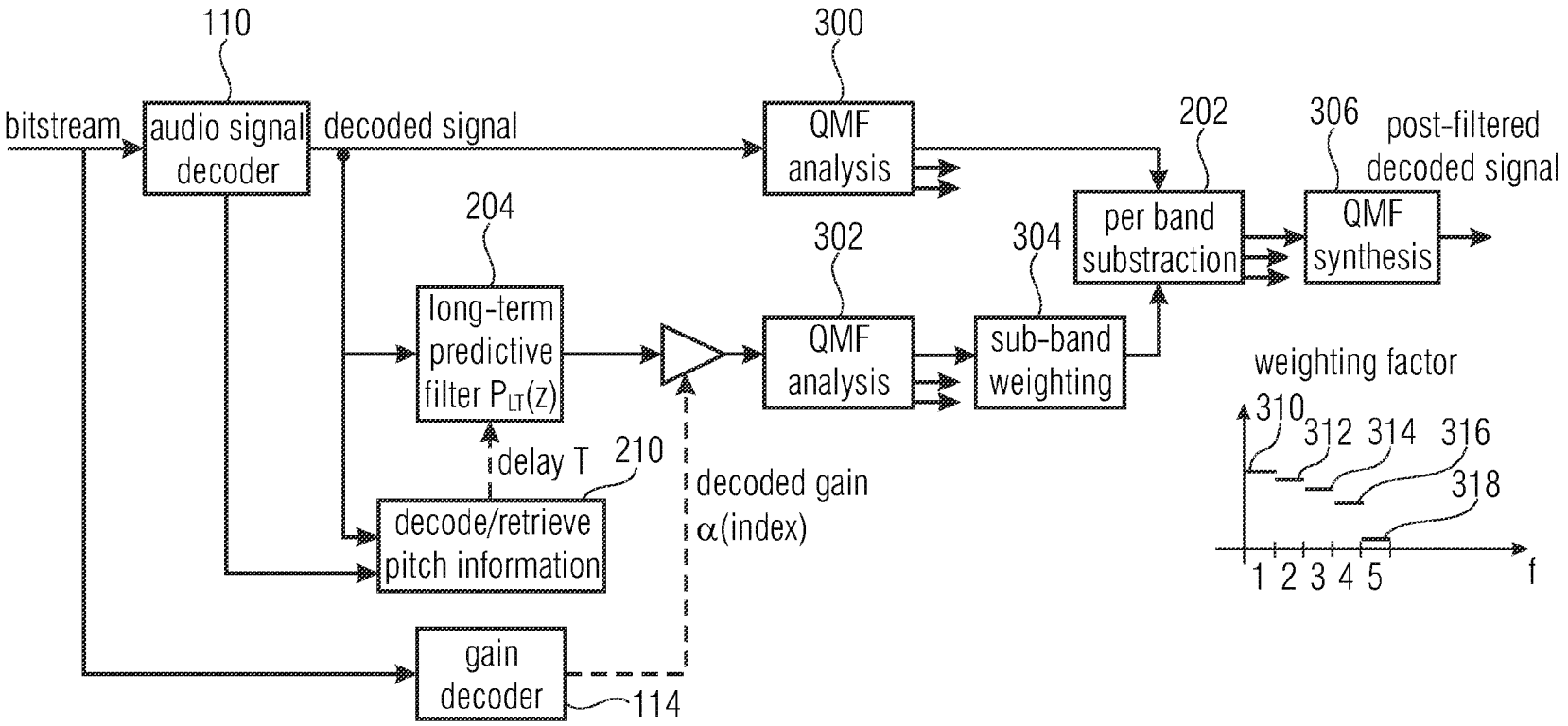
FIG. 3 illustrates a further apparatus for processing an encoded audio signal operating in a spectral domain.

FIG. 2 illustrates an implementation of the present invention operating in the time-domain. Contrary thereto, FIG. 3 illustrates an implementation of the present invention operating in a spectral domain. Exemplarily, a QMF subband domain is illustrated in FIG. 3. In contrast to FIG. 2, a QMF analyzer 300 is provided for converting the decoded signal into a spectral domain, advantageously the QMF domain. Furthermore, a second time to spectrum converter 302 is provided which may be implemented as the QMF analysis block. The low-pass filter 208 of FIG. 2 is replaced by a subband weighting block 304 and the subtractor 202 of FIG. 2 is replaced by a per band subtractor 202. Additionally, a QMF synthesis block 306 is provided. In particular, the QMF analysis 302 provides a plurality of individual subbands or spectral values for individual frequency bands. These individual bands are then subjected to the sub-band weighting 304, where the weighting factor is different for each individual band so that all weighting factors together represent, for example, a low-pass filter characteristic. Thus, when for example five bands are considered, and when a low-pass filter characteristic is to be implemented by the subband weighting blocks 304 for the individual bands, then the weighting factors applied by the subband weighting blocks 304 will decrease from a high value for the lowest band to a lower value for a higher band. This is illustrated by the sketch to the right of FIG. 3 exemplarily illustrating five bands with band numbers 1, 2, 3, 4, 5, where each band has an individual weighting factor. Band 1 has the weighting factor 310 applied by block 304, band 2 has the weighting factor 312, band 3 has the weighting 314, band 4 has the weighting factor 316 and band 5 has the weighting factor 318. It can be seen that a weighting factor for a higher band such as band 5 is lower than a weighting factor for the lower band such as band 1. Thus, a low-pass filter characteristic is implemented. On the other hand, the weighting factors can be arranged in a different order in order to apply a different filter characteristic depending on the certain use case.

Thus, compared to FIG. 2, a time-domain low-pass filtering in block 208 is replaced by the two time-to-spectrum converters 300, 302 and the spectrum-to-time converter 306.

Figure 4:
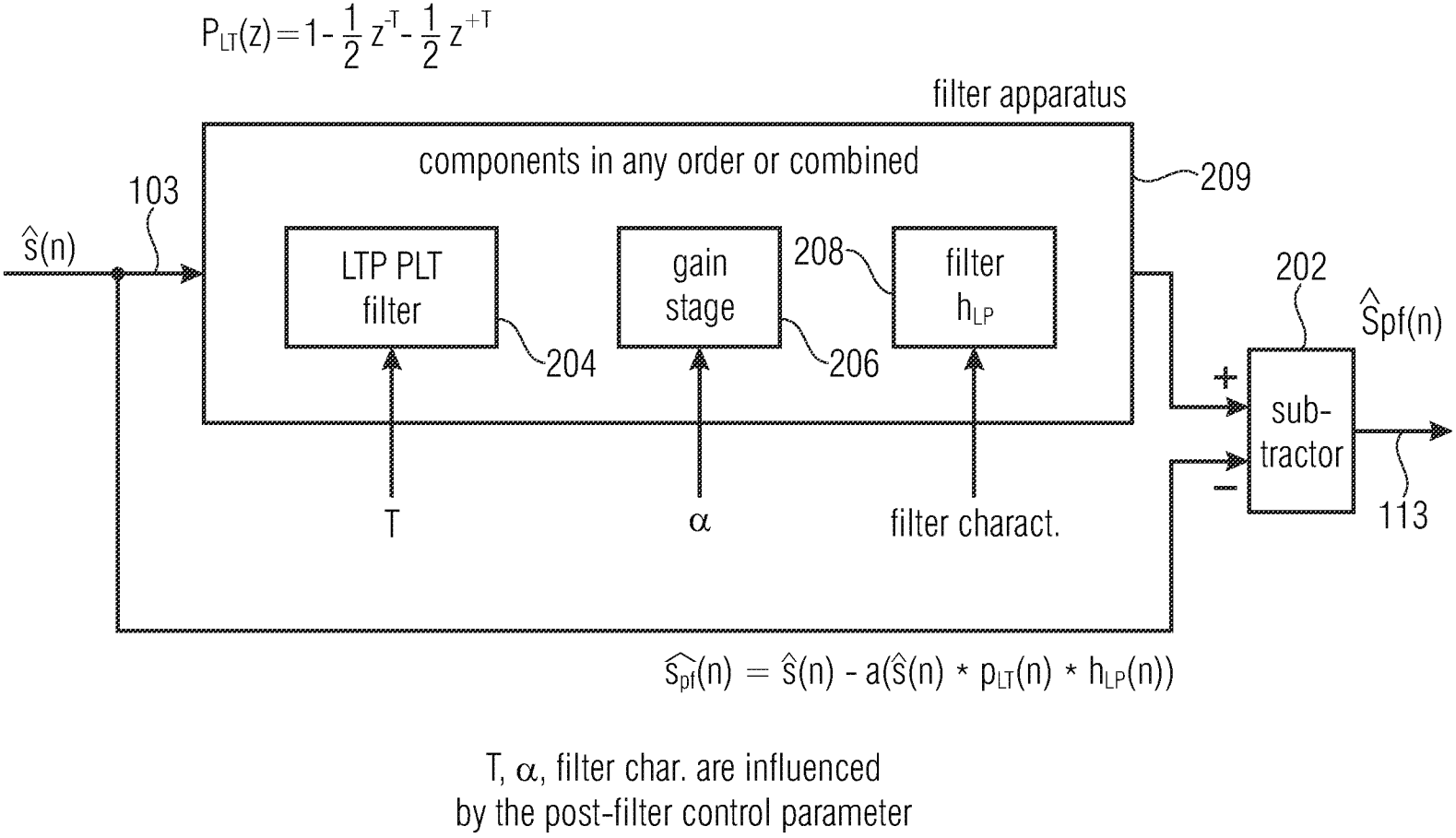
FIG. 4 illustrates a schematic representation of a controllable bass post-filter of FIG. 1.

FIG. 4 illustrates an implementation of the controllable bass post-filter 112 of FIG. 1. Advantageously, the bass post-filter 112 comprises a filter apparatus 209 and a subtractor 202. The filter apparatus receives, at its input, the decoded signal 103. Advantageously, the filter apparatus 208 comprises a functionality of a long-term prediction filter 204, the functionality of a gain stage 206 and the functionality of a signal manipulator, where this signal manipulator can, for example, be an actual filter 208 as would be the case in the implementation of FIG. 2. Alternatively, the signal manipulator can be a weighter for an individual subband or spectrum band as in the implementation of FIG. 3, element 304.

Elements 204, 206, 208 can be arranged in any order or any combination and can even be implemented within a single element as discussed in the context of FIG. 2. The output of the subtractor 202 is the processed or post-filtered signal 113.

Depending on the implementation, the controllable parameters of the filter apparatus are the delay T for the long-term prediction filter 204, the gain value a for the gain stage 206 and the filter characteristic for the signal manipulator/filter 208. All these parameters can be individually or collectively influenced by the bass post-filter control parameter additionally included in the bitstream as discussed in the context of element 101 of FIG. 1.

Figure 5:
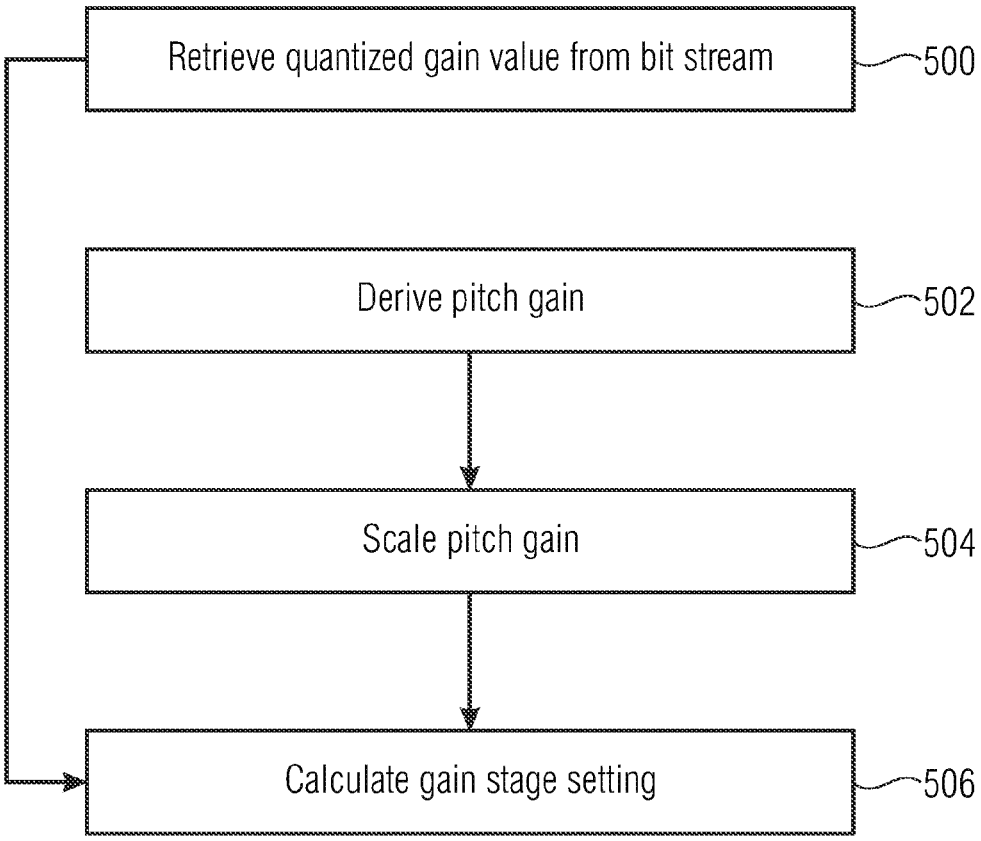
FIG. 5 illustrates operations performed by the controller of FIG. 1.

FIG. 5 illustrates a procedure for deriving the actually decoded gain α(index) illustrated in FIG. 3. To this end, a quantized gain value is retrieved from the bitstream by parsing the encoded signal to obtain the bass post-filter control parameter representing the retrieved value of step 500. Furthermore, in step 502 a pitch gain is derived using the information on the pitch gain included in the encoded audio signal or by analyzing the decoded audio signal as discussed in the context of block 210 in FIG. 2 and FIG. 3. Then, subsequently the derived pitch gain 502 is scaled using a scaling factor being greater than zero and lower than 1.0 as illustrated in step 504. Then, the gain stage setting or gain value α(index) is calculated using the quantized gain value obtained in step 500 and the scaled pitch gain obtained in step 504. In particular, reference is made to equation (7) in FIG. 7*b*. The gain stage setting α(index) calculated in step 506 of FIG. 5 relies on a scaled pitch gain obtained by a step 504. The pitch gain is $g_{ltp}$ and the scaling factor in this embodiment is 0.5. Other scaling factors between 0.3 and 0.7 are of advantage as well. The pitch gain $g_{ltp}$ used in equation (7) in FIG. 7*b* is calculated/retrieved by block 210 of FIG. 3 or FIG. 2 as discussed before and corresponds to the information on the pitch gain included in the encoded audio signal.

Figure 6:
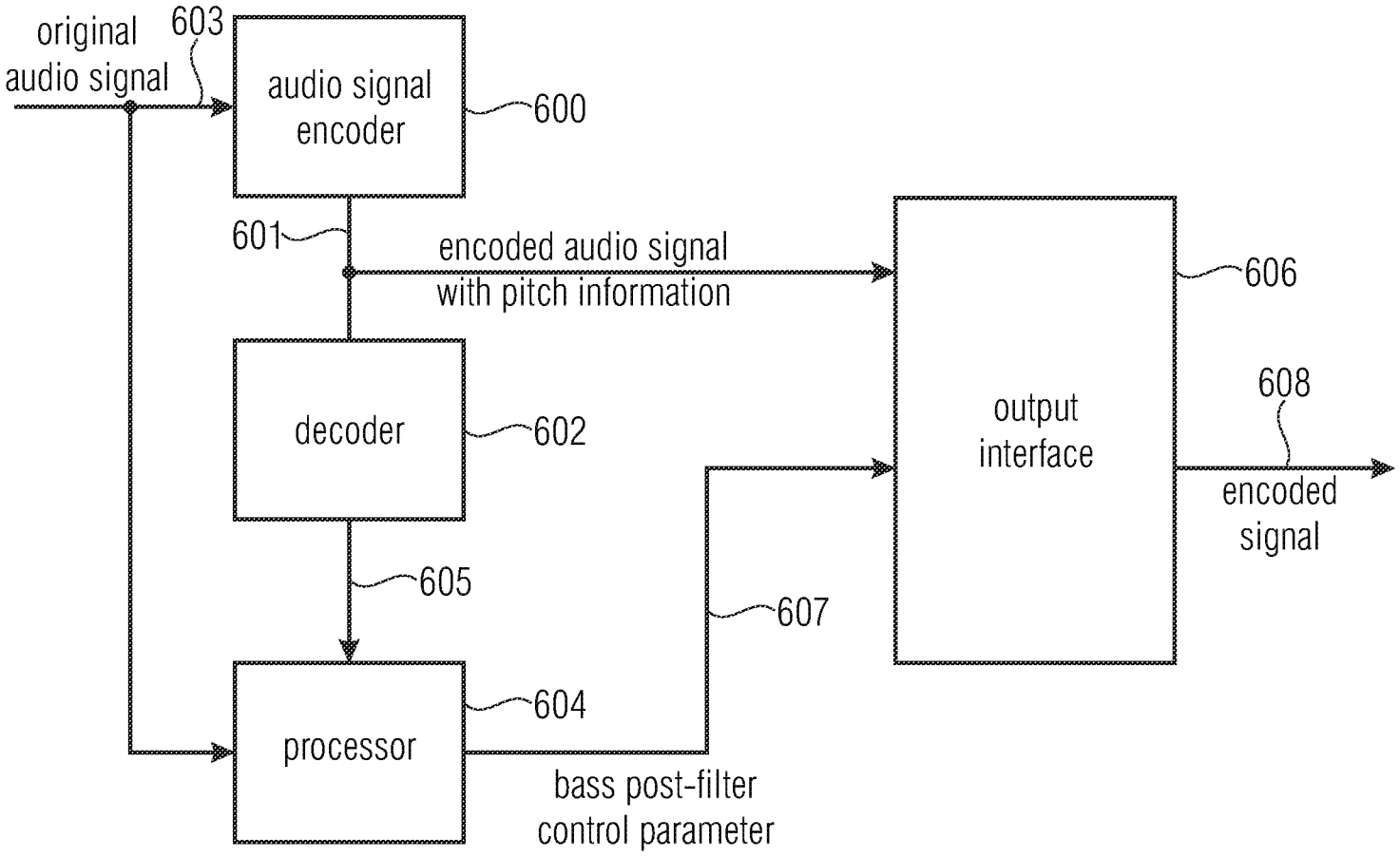
FIG. 6 illustrates an encoder for generating an encoded signal in an embodiment.

FIG. 6 illustrates an encoder for generating an encoded signal in accordance with an embodiment of the present invention. In particular, the encoder comprises an audio signal encoder 600 for generating an encoded audio signal 601 comprising information on a pitch gain or a pitch delay, and this encoded audio signal is generated from an original audio signal 603. Furthermore, a decoder 602 is provided for decoding the encoded audio signal to obtain a decoded audio signal 605. Furthermore, a processor 604 is provided for calculating a bass post-filter control parameter 607 fulfilling an optimization criterion, wherein the decoded signal 605 and the original audio signal 603 are used for calculating the bass post-filter control parameter 607. Furthermore, the encoder comprises an output interface 606 for outputting the encoded signal 608 having the encoded audio signal 601, the information on the pitch gain and the information on the pitch value and additionally having the bass post-filter control parameter 607.

It is to be emphasized that although not explicitly stated, similar reference numbers in the figures illustrate similar elements and changes will appear from the discussion of the individual elements in the context of the individual figures.

In an embodiment, the processor 604 is configured to calculate the bass post-filter control parameter so that a signal-to-noise ratio between an original signal input into the audio signal encoder 600 and a decoded and bass post-filtered audio signal is minimized.

Figure 7A:
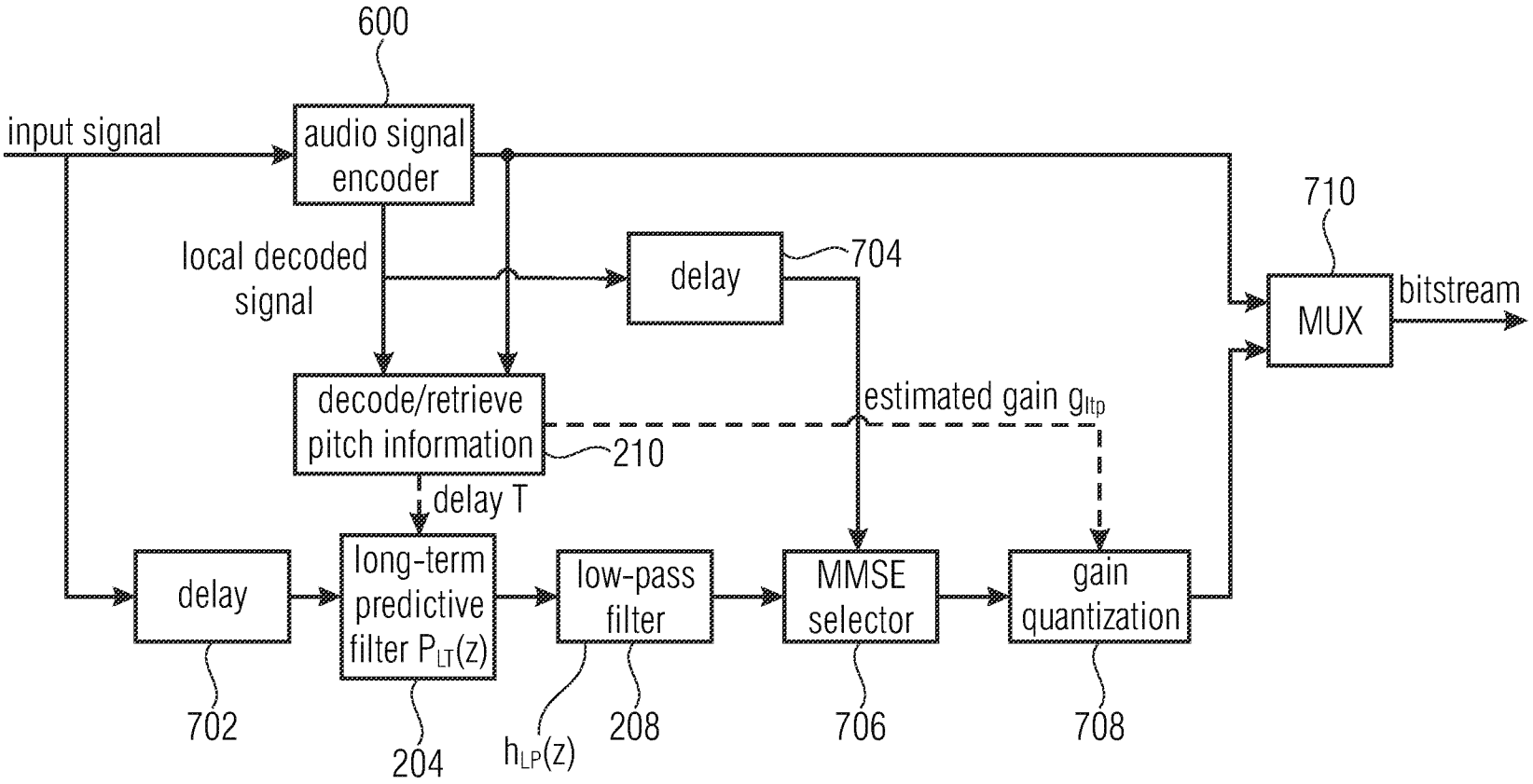
FIG. 7*a* illustrates a further embodiment of an encoder.

In a further embodiment as illustrated in FIG. 7*a*, the processor 604 comprises a long-term prediction filter 204 controlled by a pitch delay T, a low-pass filter 208 or a gain stage 206, and wherein the processor 604 is configured to generate, as the bass post-filter control parameter, a pitch delay parameter, a low-pass filter characteristic or a gain stage setting.

In a further embodiment, the processor 604 further comprises a quantizer for quantizing the bass post-filter control parameter. In the embodiment of FIG. 7*a*, this quantizer is a gain quantizer 708. In particular, the quantizer is configured to quantize to a predetermined number of quantization indices which have a significantly smaller resolution compared to a resolution provided by a computer or processor. Advantageously, the predetermined number of quantization indices is equal to 32 allowing a 5-bit quantization, or even equal to 16 allowing a 4-bit quantization, or even equal to 8 allowing a 3-bit quantization, or even equal to 4 allowing a 2-bit quantization.

In an embodiment, the processor 604 is configured to calculate the bass post-filter control parameters so that the optimization criterion is fulfilled for quantized bass post-filter control parameters. Thus, the additional inaccuracy introduced by the quantization is already included into the optimization process.

The post-filtering in known technology is based on a strong assumption regarding the nature of the signal and the nature of the coding artifacts. It is based on estimators, the gain α, the delay T and the low-pass filter, which may not be optimal. This invention proposes a method for optimizing at least one of the parameter at the encoder side before quantizing it and sending it to the decoder.

An aspect of the invention is about determining analytically (FIG. 7*b*, equations (1)-(5)) the optimal gain α to apply in the bass post-filter. The coding gain may be expressed as a Signal-to-Noise Ratio in dB:

$$SNR_c = 10 \cdot \log\left(\frac{\sum_{n=0}^{N-1}(s(n))^2}{\sum_{n=0}^{N-1}(s(n)-\hat{s}(n))^2}\right)$$

Where s(n) is the original signal and ŝ(n) the decoded version. This coding gain is modified after applying the post-filter and becomes:

$$SNR_{pf}(\alpha) = 10 \cdot \log\left(\frac{\sum_{n=0}^{N-1}(s(n))^2}{\sum_{n=0}^{N-1}(s(n)-\hat{s}(n)+\alpha(\hat{s}(n)*p_{LT}(n)*h_{LP}(n)))^2}\right)$$

Where $s_e(n)=(\hat{s}(n)*p_{LT}(n)*h_{LP}(n))$ is the anti-harmonic component filtered by the low-pass filter $H_{LP}(z)$.

Optimizing the gain α is terms of coding gain is equivalent to estimate the minimum mean square error. It can be expressed as:

$$\underset{\alpha}{\operatorname{argmax}} SNR_{pf}(\alpha) = \underset{\alpha}{\operatorname{argmin}} \sum_{n=0}^{N-1}(s(n)-\hat{s}(n)+\alpha \cdot s_e(n))^2$$

The optimal gain $\tilde{\alpha}$ is then given by:

$$\tilde{\alpha} = -\frac{\sum_{n=0}^{N-1}(s(n)-\hat{s}(n)) \cdot s_e(n)}{\sum_{n=0}^{N-1}(s(n)-\hat{s}(n))^2}$$

The maximum SNR is then $SNR_{pf}(\tilde{\alpha})$.

The optimal gain has to be computed at the encoder side as it needs the original signal. The optimal gain must be then quantized. In the embodiment it is done by coding it relatively to an estimation of the gain, which can be already decoded from the bitstream and used by the decoder. This estimation may be the long-term prediction quantized gain $g_{ltp}$ multiplied by 0.5. If no Long-term prediction is available in the audio coder, one can code the absolute value of the optimal gain and compute the estimate of the delay T at both encoder and decoder from the decoded signal. Though, in this case and in the embodiment, the optimal gain is not sent and set at the decoder side to zero. The post-filter has then no effect on the decoded signal, and the delay T does not have to be estimated. In this case the bass post-filter control parameter 607 does not need to be either computed or transmitted.

In the embodiment the quantization is done as described by the following pseudo-code (FIG. 7*b*, equation (6)):

$$\text{index} = \min\left(2^k - 1, \max\left(0, \frac{2^k - 1}{\alpha_{max} - \alpha_{min}} \cdot \left(\frac{\tilde{\alpha}}{0.5 g_{ltp}} - \alpha_{min}\right)\right)\right)$$

Where k is the number of bits on which is quantized the optimal gain, $\alpha_{min}$ and $\alpha_{max}$ are the minimum and the maximum relative quantized gains respectively. In the embodiment k=2, i.e. the quantized gain is sent every frame on 2 bits. In the embodiment $\alpha_{max}$=1.5 and $\alpha_{min}$=0.

The decoded optimal gain is then equal to (FIG. 7*b*, equation (7)):

$$\alpha(\text{index}) = \left(\frac{\alpha_{max} - \alpha_{min}}{2^k - 1} \cdot \text{index} + \alpha_{min}\right) \cdot 0.5 g_{ltp}$$

It can happen that the above quantization in not optimal in terms of SNR. It can be avoided by computing for each representative values the resulting $SNR_{pf}(\alpha(\text{index}))$, but if the number of bits k is high the computational complexity can explodes. Instead one can quantize the gain as it is described above and then check if the nearby representative values are a better choice (FIG. 7*b*, equation (8)):

$$\text{index_new} = \underset{index-1, index, index+1}{\text{argmax}} SNR_{pf}(\alpha(\text{index}))$$

index_new will be then transmitted instead of index.

Figure 8:
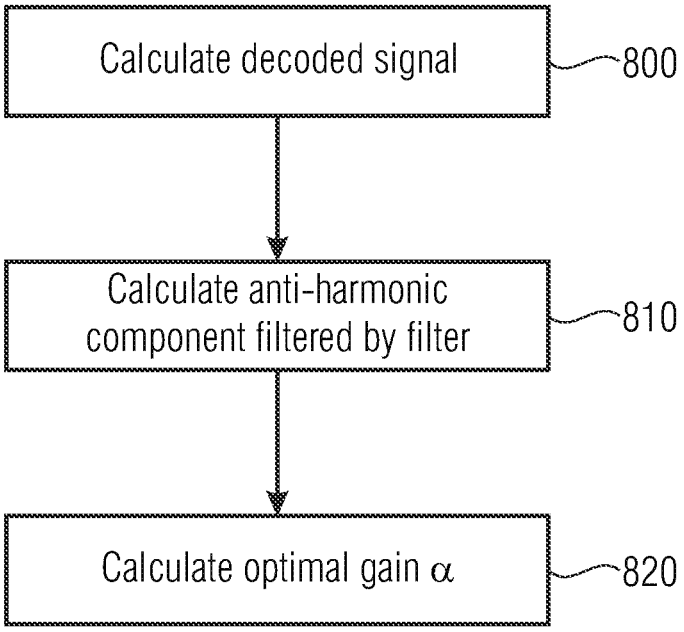
FIG. 8 illustrates procedures performed by the processor of FIG. 6.

FIG. 8 illustrates a further embodiment of the encoder-side method. In step 800, the decoded signal is calculated. This is done by, for example, the decoder 602 in FIG. 6. In step 810, the anti-harmonic component filtered by the filter is calculated by the processor 604. The anti-harmonic component filtered by the filter 208, for example in FIG. 7*a*, is $s_e(n)$ as defined in equation (3). Thus, the anti-harmonic component filtered by the, for example, low-pass filter $H_{LP}(z)$ is obtained by filtering the decoded signal at the output 605 of FIG. 6 using the long-term prediction filter 204, for example of FIG. 7*a* and the low-pass filter 208 having a transfer function in the z-domain $h_{LP}(z)$.

Figure 9:
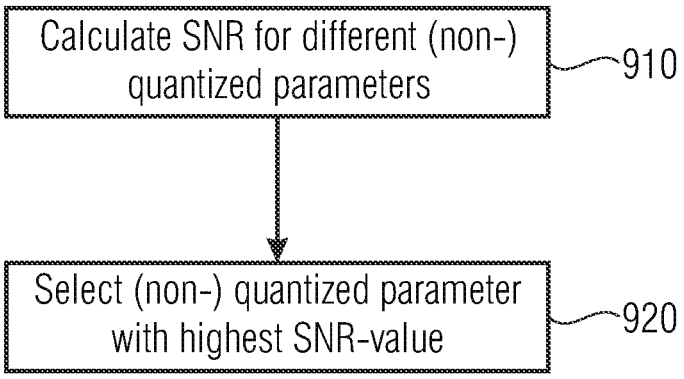
FIG. 9 illustrates steps or procedures performed by the processor of FIG. 6 in a further embodiment.
Figure 10:
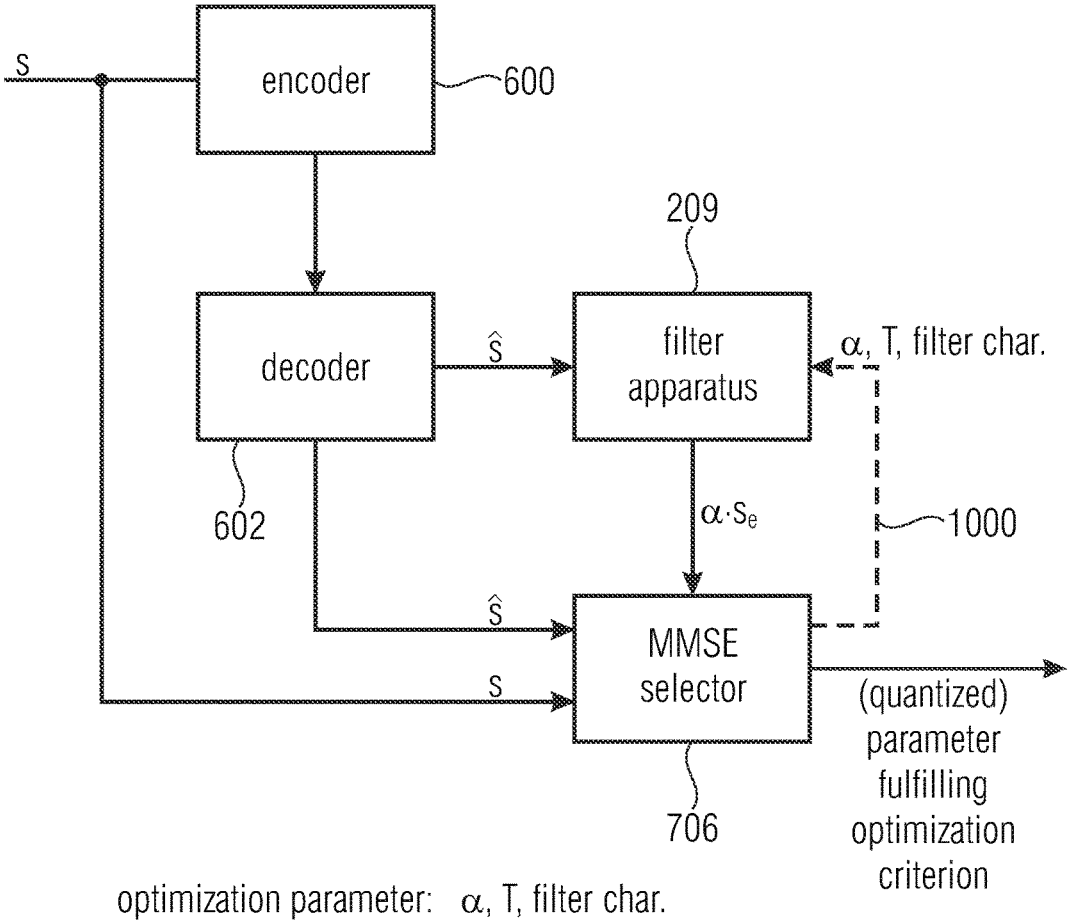
FIG. 10 illustrates a further implementation of the encoder/processor of FIG. 6.

Then, the optimal gain α is calculated by the processor 604 as illustrated in step 820 of FIG. 8. This may, for example, be done using equation (4) or equation (5) in order to obtain a non-quantized optimum gain. The best quantized gain can, for example, be obtained by equation (6) or equation (8) of FIG. 7*b*. However, the calculation of the optimal gain α as defined in step 820 does not necessarily have to be performed in an analytical way, but can also be done by any other procedure using the calculated anti-harmonic component filtered by the filter on the one hand and using the original signal s on the other hand. To this end, reference is made to FIG. 9 and FIG. 10. FIG. 10 illustrates a further embodiment of the inventive encoder. The encoder 600 in FIG. 10 corresponds to the audio signal encoder 600 of FIG. 6. Similarly, the decoder 602 of FIG. 10 corresponds to the decoder 602 of FIG. 6. Furthermore, the processor 604 of FIG. 6 comprises, on the one hand, the filter apparatus 209 and on the other hand, the MMSE selector 706.

The decoder 602 calculates the decoded signal ŝ. The decoded signal ŝ is input into the filter apparatus 209 in order to obtain the anti-harmonic component as discussed in step 810 of FIG. 8 multiplied by a certain gain factor α. Then, MMSE selector 706 calculates, for example, a signal-to-noise ratio for different (non-) quantized parameters as indicated at step 910 in FIG. 9. The calculation of the SNR is performed by evaluating the equation (2) or (4) or any other procedure involving $(s(n)-\hat{s}(n)+\alpha \cdot s_e(n))$. Then, as indicated by step 920, the MMSE selector 706 selects the non-quantized or, alternatively, the quantized parameter with the highest SNR value in order to obtain, at the output of block 706, the quantized or non-quantized parameter fulfilling the optimization criterion.

Thus, the MMSE selector 706 may perform an exhaustive search, for example, for each α value. Alternatively, the MMSE selector can set a certain a value and then calculate different anti-harmonic components $\alpha \cdot s_e$ for individual pitch delay values T. Furthermore, a certain α value and a certain T value can be predefined and individual anti-harmonic components can be calculated for individual filter characteristics. This is illustrated by the control line 1000 in FIG. 10. In further embodiments, a multi-dimensional optimization is performed in that all available combinations of α, T values and individual filter characteristics are set and the corresponding SNR value is calculated for each combination of the three parameters and the processor 604 corresponding to the combination of the filter apparatus 209 and the MMSE selector 706 when selecting the quantized or non-quantized parameter with the highest SNR value in an embodiment or one of the for example ten parameter combinations having the highest SNR values among all possibilities.

Subsequently, additional reference is made to FIG. 1 to FIG. 5 illustrating the decoder-side of the present invention.

At the decoder side the adaptive bass post-filter is illustrated in FIG. 1 or 2. First the gain is decoded, and then the used for post-filtering of the decoded audio signal. It is worth notifying that in case the gain is quantized to zero, it will be is equivalent to by-pass the post-filtering. In this last case only the memory of the filters are updated.

Finally, it is not restricted that the low-pass filter is performed in the time domain. It can be applied in the frequency by mean of a multiplication of the frequency bins and sub-bands.

One can use a FFT, a MDCT, a QMF or any spectral decomposition. In the embodiment the low-pass filter is applied in time-domain at the encoder side and in QMF domain at the decoder.

According to other embodiments, it is also possible to optimize at the encoder side the other parameters of the bass post-filtering, i.e. the delay T and the filter $h_{LP}(n)$. The analytic resolution of their optimization is more complex, but an optimization can be achieved by computing the coding gain $SNR_{pf}(T)$ or $SNR_{pf}(h_{LP}(n))$ at the output of the post-filter with different parameter candidates. The candidate having the best SNR is then selected and transmitted. For the delay, good candidates can be chosen in the surrounding of the first estimation, and then only the delta with the estimated delay needs to be transmitted. For the low-pass filter, a set of filter candidates can be predefined and the SNR is computed for each of them. Naturally it is not restricted that all filters show a low-pass characteristic. One or more candidates can be an all-pass, a band-pass, or a high-pass filter. The index of the best filter is then transmitted to the decoder. In another embodiment one can do a multi-dimensional optimization be optimizing in the same time the combination of two or three parameters.

Although the present invention has been described in the context of block diagrams where the blocks represent actual or logical hardware components, the present invention can also be implemented by a computer-implemented method. In the latter case, the blocks represent corresponding method steps where these steps stand for the functionalities performed by corresponding logical or physical hardware blocks.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive transmitted or encoded signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disc, a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a non-transitory storage medium such as a digital storage medium, or a computer-readable medium) comprising, recorded thereon, the computer program for performing one of the methods described herein. The data carrier, the digital storage medium or the recorded medium are typically tangible and/or non-transitory.

A further embodiment of the invention method is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] 3GPP TS 16.290 Audio codec processing functions; Extended Adaptive Multi-Rate-Wideband (AMR-WB+) codec; Transcoding functions

[2] Recommendation ITU-T G.718: "Frame error robust narrow-band and wideband embedded variable bit-rate coding of speech and audio from 8-32 kbit/s"

[3] International patent WO2012/000882 A1, "Selective Bass Post Filter".

The invention claimed is:

1. An apparatus for processing an encoded signal, the encoded signal comprising an encoded audio signal comprising information on a pitch delay, a pitch gain, and a bass post-filter control parameter, comprising:

an audio signal decoder configured for decoding the encoded audio signal using the information on the pitch delay or the pitch gain to acquire a decoded audio signal;

a controllable bass post-filter configured for filtering the decoded audio signal to acquire a processed signal, wherein the controllable bass post-filter comprises a variable bass post-filter characteristic controllable by the bass post-filter control parameter; and a controller configured for setting the variable bass post-filter characteristic in accordance with the bass post-filter control parameter comprised in the encoded signal, wherein the controllable bass post-filter comprises a filter apparatus comprising a long-term prediction filter, a gain stage, a signal manipulator, and a subtractor configured for subtracting an output of the filter apparatus from the decoded audio signal, wherein the bass post-filter control parameter comprises a quantized gain value for the gain stage, wherein the controller is configured to set the gain stage in accordance with the quantized gain value, wherein the controller comprises a block configured for decoding or retrieving the information on a pitch delay and wherein the controller is configured to set the long-term prediction filter in accordance with the pitch delay, wherein the controller is configured to retrieve the quantized gain value from the encoded signal to acquire the bass post-filter control parameter, to scale the pitch gain by a constant factor lower than 1 and greater than 0 to acquire a scaled pitch gain; and to calculate a setting of the gain stage using the scaled pitch gain and using the quantized gain value.

2. The apparatus of claim 1, wherein the controllable bass post-filter is configured to operate in a time domain, wherein the signal manipulator is implemented as a low-pass filter, an all-pass filter, a band-pass filter or a high-pass filter, and wherein the bass post-filter control parameter comprises in addition to a gain value for the gain stage a filter characteristic information for the signal manipulator and, wherein the controller is configured to set the signal manipulator in accordance with the information on the filter characteristic.

3. The apparatus of claim 1, wherein the controllable bass post-filter is configured to operate in a spectral domain, wherein a first time-to-spectrum converter configured for generating a spectral representation of the decoded audio signal is provided, wherein the controllable bass post-filter comprises a second time-to-spectrum converter to generate subband signals for different subbands and a signal manipulator for each subband, wherein the signal manipulator for a subband is configured for performing a weighting operation using a weighting factor, and wherein individual weighting factors for signal manipulators for individual subbands together implement a low-pass filter characteristic, an all-pass filter characteristic, a band-pass filter characteristic or a high-pass filter characteristic, wherein the subtractor is configured for subtracting an output of the filter apparatus for a subband from a corresponding subband generated by the first time-to-spectrum converter to generate a subtracted subband signal; and a spectrum-to-time converter configured for converting subtracted subband signals into a time domain to acquire the processed signal;

wherein the bass post-filter control parameter comprises a gain value for the gain stage and a filter characteristic information for the signal manipulator.

4. The apparatus of claim 1, wherein the bass post-filter control parameter is quantized relative to the information on the pitch delay or the pitch gain comprised in the encoded audio signal, and wherein the controller is configured to set the variable bass post-filter characteristic in accordance with the information on the pitch delay or the information on the pitch gain and the bass post-filter control parameter.

5. The apparatus of claim 4, wherein the controller is configured to set the variable bass post-filter characteristic based on a product of the information on the pitch delay or the pitch gain and the bass post-filter characteristic.

6. The apparatus of claim 5, wherein the controller is configured for calculating a gain for the variable gain stage using a product between the bass post-filter control parameter and the pitch gain and a constant factor lower than 1 and greater than 0.

7. The apparatus of claim 1, wherein the controllable bass post-filter comprises a long-term prediction filter and a variable gain stage, wherein the long-term prediction filter is controlled by the information on the pitch gain comprised in the encoded audio signal, and wherein the controller is configured to set a gain of the variable gain stage using the bass post-filter control parameter alone or in combination with the information on the pitch gain.

8. The apparatus of claim 7, wherein a low-pass filter or a combination of a time-to-spectrum converter and a subband weighter is connected to an output of the variable gain stage or an output of the long-term prediction filter.

9. An encoder for generating an encoded signal, comprising:

an audio signal encoder configured for generating an encoded audio signal comprising information on a pitch gain or a pitch delay from an original audio signal;

a decoder configured for decoding the encoded audio signal to acquire a decoded audio signal;

a processor configured for calculating a bass post-filter control parameter fulfilling an optimization criterion using the decoded audio signal and the original audio signal; and an output interface configured for outputting the encoded signal comprising the encoded audio signal comprising the information on the pitch gain or the pitch delay and the bass post-filter control parameter, wherein the processor further comprises a quantizer configured for quantizing the bass post-filter control parameter to one of a predetermined number of quantization indices, and wherein the processor is configured to calculate the bass post-filter control parameter so that the optimization criterion is fulfilled for a quantized bass post-filter control parameter.

10. The encoder of claim 9, wherein the processor is configured to calculate the bass post-filter control parameter so that a signal-to-noise ratio between the original audio signal and a decoded and bass post-filtered audio signal is minimized.

11. The encoder of claim 9, wherein the processor comprises a long-term prediction filter, a low-pass filter or a gain stage, and wherein the processor is configured to generate, as the bass post-filter control parameter, a pitch delay parameter, a low-pass filter characteristic information or a gain stage setting.

12. The encoder of claim 9, wherein the quantizer is configured for quantizing the bass post-filter control parameter with respect to the information on the pitch gain or the information on the pitch delay.

13. The encoder of claim 12, wherein the quantizer is configured to quantize the bass post-filter control parameter using the following equation:

$$\text{index} = \min\left(2^k - 1, \max\left(0, \frac{2^k - 1}{\alpha_{max} - \alpha_{min}} \cdot \left(\frac{\tilde{\alpha}}{cg_{ltp}} - \alpha_{min}\right)\right)\right),$$

wherein index is the quantized bass post-filter control parameter, wherein min is a minimum function, wherein max is a maximum function, wherein k is the number of bits used to represent the index, wherein $\alpha_{min}$ is the minimum relative quantized gain, wherein $\alpha_{max}$ is the maximum relative quantized gain, wherein $\tilde{\alpha}$ is the non-quantized bass post-filter control parameter, wherein $g_{ltp}$ is the information on the patch gain, and wherein c is a constant factor greater than 0 and lower than 1.

14. The encoder in accordance with claim 9, wherein the processor is configured for calculating SNR values for a plurality of quantized or non-quantized bass post-filter control parameters and to select the quantized or non-quantized bass post-filter control parameter resulting in an SNR value being among the five highest SNR values calculated, and wherein the output interface is configured for introducing the selected quantized or non-quantized bass post-filter control parameter into the encoded signal.

15. A method of processing an encoded signal, the encoded signal comprising an encoded audio signal comprising information on a pitch delay, a pitch gain, and a bass post-filter control parameter, comprising:

decoding the encoded audio signal using the information on the pitch delay or the pitch gain to acquire a decoded audio signal;

filtering the decoded audio signal to acquire a processed signal using a controllable bass post-filter comprising a variable bass post-filter characteristic controllable by the bass post-filter control parameter; and setting the variable bass post-filter characteristic in accordance with the bass post-filter control parameter comprised in the encoded signal, wherein the controllable bass post-filter comprises a filter apparatus comprising a long-term prediction filter, a gain stage, a signal manipulator, and a subtractor configured for subtracting an output of the filter apparatus from the decoded audio signal, wherein the bass post-filter control parameter comprises a quantized gain value for the gain stage or a filter characteristic information for the signal manipulator, and wherein the setting comprises setting the gain stage in accordance with the quantized gain value, or setting the signal manipulator in accordance with the information on the filter characteristic, wherein the setting comprises decoding or retrieving the information on a pitch delay and wherein the long-term prediction filter is set in accordance with the pitch delay, wherein the setting comprises retrieving the quantized gain value from the encoded signal to acquire the bass post-filter control parameter, scaling the pitch gain by a constant factor lower than 1 and greater than 0 to acquire a scaled pitch gain; and calculating a setting of the gain stage using the scaled pitch gain and using the quantized gain value.

16. A method for generating an encoded signal, comprising:

generating an encoded audio signal comprising information on a pitch gain or a pitch delay from an original audio signal;

decoding the encoded audio signal to acquire a decoded audio signal;

calculating a bass post-filter control parameter fulfilling an optimization criterion using the decoded audio signal and the original audio signal; and outputting the encoded signal comprising the encoded audio signal comprising the information on the pitch gain or the pitch delay and the bass post-filter control parameter, wherein the calculating further comprises quantizing the bass post-filter control parameter to one of a predetermined number of quantization indices, and wherein the bass post-filter control parameter is calculated so that the optimization criterion is fulfilled for a quantized bass post-filter control parameter.

17. A non-transitory storage medium having stored thereon a computer program for performing, when running on a computer or processor, a method of processing an encoded signal, the encoded signal comprising an encoded audio signal comprising information on a pitch delay, a pitch gain, and a bass post-filter control parameter, the method comprising:

decoding the encoded audio signal using the information on the pitch delay or the pitch gain to acquire a decoded audio signal;

filtering the decoded audio signal to acquire a processed signal using a controllable bass post-filter comprising a variable bass post-filter characteristic controllable by the bass post-filter control parameter; and setting the variable bass post-filter characteristic in accordance with the bass post-filter control parameter comprised in the encoded signal, wherein the controllable bass post-filter comprises a filter apparatus comprising a long-term prediction filter, a gain stage, a signal manipulator, and a subtractor for subtracting an output of the filter apparatus from the decoded audio signal, wherein the bass post-filter control parameter comprises a quantized gain value for the gain stage or a filter characteristic information for the signal manipulator, and wherein the setting comprises setting the gain stage in accordance with the quantized gain value, or setting the signal manipulator in accordance with the information on the filter characteristic, wherein the setting comprises decoding or retrieving the information on a pitch delay and wherein the long-term prediction filter is set in accordance with the pitch delay, wherein the setting comprises retrieving the quantized gain value from the encoded signal to acquire the bass post-filter control parameter, scaling the pitch gain by a constant factor lower than 1 and greater than 0 to acquire a scaled pitch gain; and calculating a setting of the gain stage using the scaled pitch gain and using the quantized gain value.

18. A non-transitory storage medium having stored thereon a computer program for performing, when running on a computer or processor, a method for generating an encoded signal, the method comprising:

generating an encoded audio signal comprising information on a pitch gain or a pitch delay from an original audio signal;

decoding the encoded audio signal to acquire a decoded audio signal;

calculating a bass post-filter control parameter fulfilling an optimization criterion using the decoded audio signal and the original audio signal; and outputting the encoded signal comprising the encoded audio signal comprising the information on the pitch gain or the pitch delay and the bass post-filter control parameter, wherein the calculating further comprises quantizing the bass post-filter control parameter to one of a predetermined number of quantization indices, and wherein the bass post-filter control parameter is calculated so that the optimization criterion is fulfilled for a quantized bass post-filter control parameter.

* * * * *